US006013223A

United States Patent [19]

Schwarz

[11] Patent Number: 6,013,223

[45] Date of Patent: Jan. 11, 2000

[54] PROCESS AND APPARATUS FOR PRODUCING NON-WOVEN WEBS OF STRONG FILAMENTS

[75] Inventor: Eckhard C.A. Schwarz, Neenah, Wis.

[73] Assignee: Biax-Fiberfilm Corporation, Neenah, Wis.

[21] Appl. No.: 09/085,464

[22] Filed: May 28, 1998

[51] Int. Cl.[7] ..... D01D 5/084; D01D 5/14; D04H 3/00

[52] U.S. Cl. ..... 264/555; 264/103; 264/210.8; 264/211.14; 264/211.17; 425/66; 425/72.2; 425/378.2; 425/379.1; 425/382.2; 425/464

[58] Field of Search ..... 264/103, 210.8, 264/211.14, 211.17, 555; 425/66, 72.2, 378.2, 379.1, 382.2, 464

[56] References Cited

U.S. PATENT DOCUMENTS 3,692,618 9/1972 Dorschner et al. ..... 442/401
3,802,817 4/1974 Matsuki et al. ..... 425/66
4,818,463 4/1989 Buehning ..... 264/555
4,818,466 7/1989 Mente et al. ..... 264/555
4,847,035 7/1989 Mente et al. ..... 264/555
5,476,616 12/1995 Schwarz ..... 264/6
5,688,468 11/1997 Lu ..... 264/555

*Primary Examiner*—Leo B. Tentoni
*Attorney, Agent, or Firm*—Eckhard C.A. Schwarz

[57] ABSTRACT

An apparatus and process for extruding fiberforming thermoplastic polymers through spinning nozzles arranged in multiple rows are forming a non-woven web of high strength fibers. The molten fibers are accelerated by expanding hot gas flowing parallel to the extrusion nozzles and the fibers to a first velocity and cooled below their melting point, and subsequently accelerated to a higher velocity by an air jet fed with compressed cold air. The resulting fibers have a high degree of molecular orientation and tenacity and are collected on a moving collecting surface as a non-woven web.

11 Claims, 2 Drawing Sheets

PROCESS AND APPARATUS FOR PRODUCING NON-WOVEN WEBS OF STRONG FILAMENTS

BACKGROUND OF THE INVENTION

This invention relates to a new non-woven and spunbonded fiber process and apparatus applying multiple rows of spinning nozzles described in U.S. Pat. No. 5,476,616, which is herewith incorporated by reference. More particularly, it relates to a cooling technique using expanding hot air to introduce a high level of molecular orientation to produce strong filaments.

OBJECTS OF THE INVENTION

It is an object of the present invention to produce high strength fibers for a high capacity non-woven web process by using high velocity expanding hot air flowing parallel to the fiber stream as quench medium coupled with a cold air drawing stream to accelerate the fibers, which produces a high degree of molecular orientation in the fibers and therefore fibers of high tenacity.

Another object of the invention is to provide a spinning system allowing multiple rows of spinning nozzles to be used to achieve unusually high production capacities.

DESCRIPTION OF THE PRIOR ART

Non-woven webs are customarily produced by extruding fibers downward from a spinnerette into a jet-drawing device positioned a distance below the spinnerette. The draw jet pulls the fibers downward and accelerates them, causing attenuation and a decrease in fiber diameter, which causes a degree of molecular orientation. It is the molecular orientation within the polymeric fibers that gives the fiber its strength. This orientation is enhanced by using a cross flow air or water mist quench below the spinnerette for additional cooling, as described in U.S. Pat. No. 3,692,618. This cross flow quench is of low efficiency since the quench air velocity has to be slow to avoid turbulence which will break or rupture the fibers. U.S. Pat. No. 3,802,817 discloses a suction method where near laminar flow is used in a multistage draw jet to achieve uniform fiber diameter. In the above inventions the draw jet is located a considerable distance below the spinnerette to allow the fibers to solidify before they touch each other to avoid sticking together. In U.S. Pat. No. 5,688,468 a draw device is located several meters below the spinnerette, which is then gradually moved upward to 0.2 to 0.5 meters as fiber attenuation is increased, while a water mist spray perpendicular to the fiber stream is used for quenching. The fibers exiting the draw jet are typically collected on a moving belt or screen as a loose web for further processing like calendering and/or spot bonding.

All the above inventions and others have in common is, that fibers fall down by gravity into a draw jet, and a low velocity quench medium is used perpendicular to the fiber stream. This achieves poor heat transfer, slow cooling, and a longer time and distance for the fibers to solidify.

SUMMARY OF THE INVENTION

In the present invention pressurized hot air is blown out of holes around each spinning nozzle at a high velocity parallel to the fibers. As the air expands, it cools quickly to solidify the fibers within a few millimeters from exiting the spinning nozzles, at the same time, the expanding air is exerting an accelerating force on the fibers away from the spinnerette and toward the draw jet. In the present invention, the fiber flow is not dependend on gravity; the process can be vertical, horizontal, or at any angle. Since the quench air is parallel to the fiber stream, high air velocities can be tolerated without rupturing the fibers, causing rapid cooling of the fibers. As can be seen from the examples below, an optimum hot air pressure and velocity is needed to achieve a high degree of molecular orientation. If no quench air is used, the fibers solidify slowly and tend to stick together in bundles in the draw jet. If fibers are accelerated too much by the quench air, or the air temperature in cavity 5 is too high, the draw jet exerts little drawing force on the fibers, the conditions resemble the "melt-blowing" process which causes little molecular orientation and therefore low strength fibers. The optimum result is achieved when the high velocity quench air accelerates the fibers somewhat, but mainly cools and solidifies the fibers, and the draw jet, using cold air, provides the majority of the fiber attenuation.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate like parts throughout; and wherein.

DETAILED DESCRIPTION OF THE DRAWINGS

Figure 1:
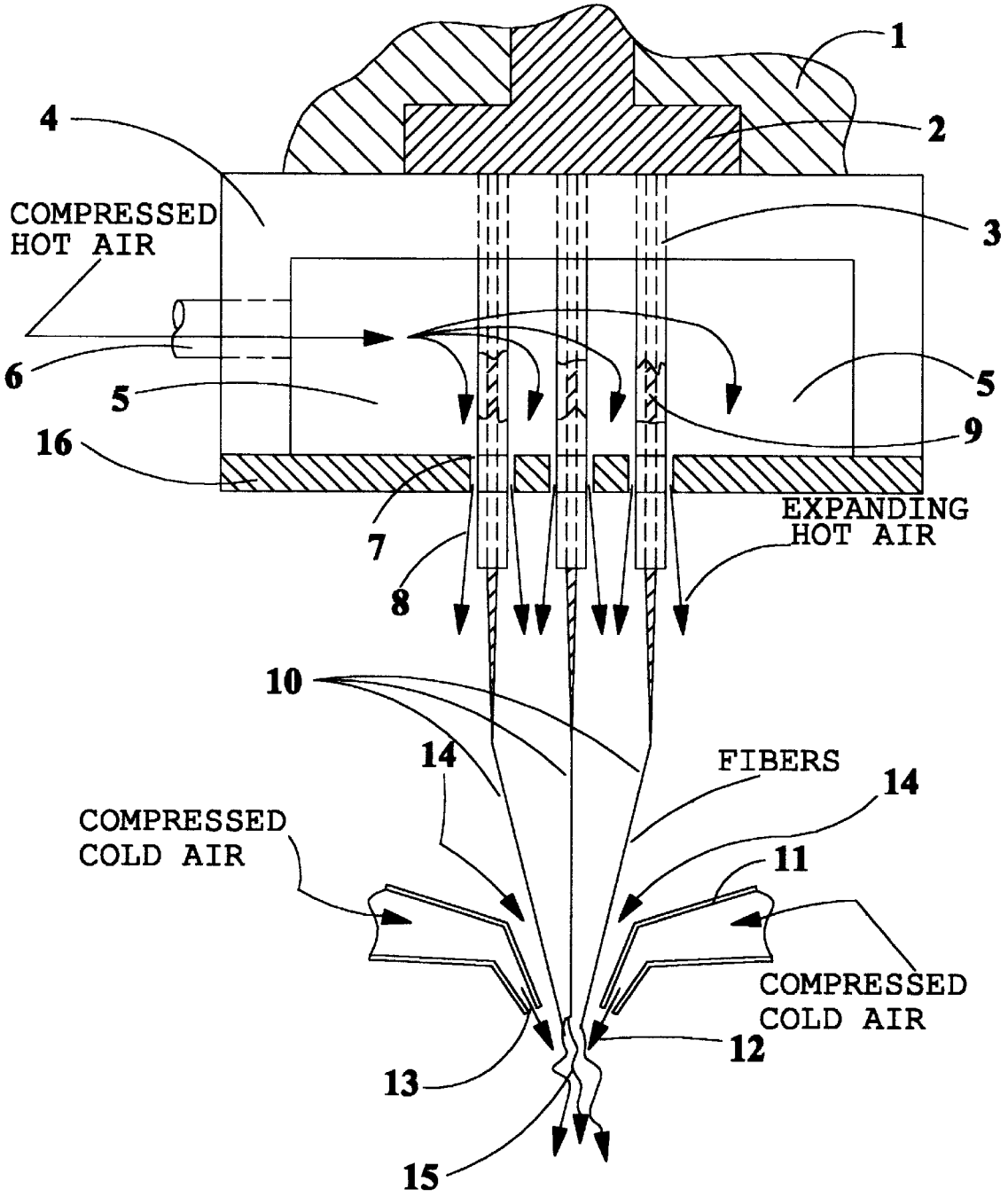
FIG. 1 is a partially schematic side view of a spinnerette assembly and the cold air draw jet of the present invention, showing the path of polymer, gas and fiber flow.

Referring now to FIG. 1, The spinnerette assembly is mounted on die body 1 which supplies thermoplastic fiber-forming polymer melt to a supply cavity 2 feeding the spinning nozzles 3 which are mounted in the spinnerette body 4 wherein nozzles 3 are spaced from each other at a distance of at least 1.3 times the outside diameter of the nozzles 3. Molten polymer is pumped through the inside cavity 9 of nozzle 3 to form a fiber after exiting at the end of the nozzle 3. The nozzles 3 lead through the gas cavity 5 which is fed with air, gas or other suitable fluids from the gas inlet 6. The nozzles 3 protrude through the center of round holes 7 in the cover plate 16. The hot pressurized air from cavity 5 is exiting around each nozzle 3 through hole 7 and expanding at a high velocity parallel to the nozzles and fiber stream along path 8. The expanding gas 8 is exerting an accelerating force on the fibers 10, causing them to cool and solidify rapidly. The fibers 10 are blown toward the entrance of draw jet 11 which exerts a strong accelerating force from the high velocity air 12 at the slots 13. The high velocity air 12 is also causing aspirated room air 14 to be drawn into the draw jet 11. The fibers 10 are accelerated at the jet exit 15 to a high velocity, which causes the attenuation of the fibers 10 to a small diameter.

Figure 2:
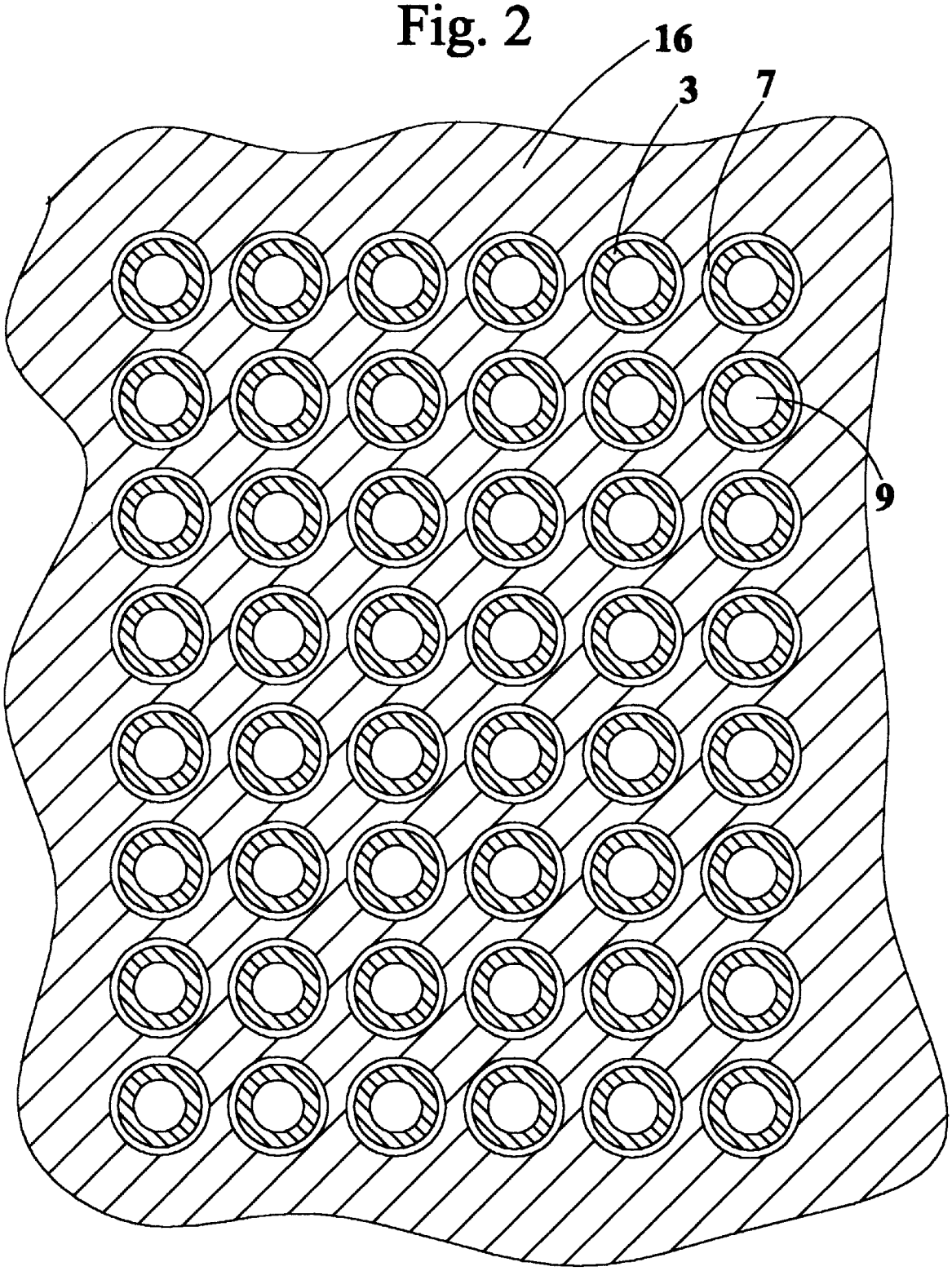
FIG. 2 is a partial bottom view of the cover plate 16, showing the position of the spinning nozzles and the air holes 7.

FIG. 2 shows a bottom view of a typical cover plate 16, showing multiple rows of nozzles 3 sticking through the round holes 7.

The following examples are included for the purpose of illustrating the invention and it is to be understood that the scope of the invention is not to be limited thereby. For Examples 1 through 8, a 5" long spinnerette was used, of the type shown in FIGS. 1 and 2. This spinnerette had 6 rows of nozzles 3; The rows and the nozzles 3 were spaced at 0.080" from center to center, had an outside diameter (OD) of 0.032", an inside diameter (ID) of 0.015". The gas cavity 5 had a height of 0.75". The hole 7 in the cover plate 16 had a diameter of 0.045". The nozzles 3 were protruding 0.080" through the cover plate 16. Table I shows the results of the Examples 1 through 8 Polypropylene of MFR (Melt Flow Rate, as determined by ASTM-method 1238-65T) 70 was used in these experiments. Molten polypropylene was fed from a 1" extruder at 500 F to the die block cavity 2. The air pressure and temperature in cavity 5 , and the polymer throughput through nozzles 3 were varied in the experiments. The air velocities at 0.25" below plate 16 was measured for each condition, and listed in Table I. Likewise, the cold air velocity was measured at 0.5" below the fiber exit of the draw jet 11.

TABLE I

NON-WOVEN FIBER ORIENTATION USING HOT QUENCH AIR AND COLD DRAW AIR
Hot air in cavity 5: 230° C., Air orifice opening per nozzle: 0.507 mm, Distance from nozzles to draw jet: 12 cm

| EXAMPLE No: | 1 | 2 | 3 | 4 | 5 | 6 | 7 | 8 |
|---|---|---|---|---|---|---|---|---|
| Hot air pressure cavity 5 (psi) | 0 | 0 | 5 | 15 | 25 | 15 | 15 | 15 |
| Air velocity, 0.25" Below nozzle (m/sec.) | — | — | 30 | 105 | 310 | 105 | 105 | 105 |
| Polymer flow rate per nozzle (g/min.) | 0.6 | 0.6 | 0.6 | 0.6 | 0.6 | 0.3 | 0.1 | 0.05 |
| Cold air velocity at draw jet (m/sec) | 150 | 310 | 310 | 310 | 310 | 310 | 310 | 310 |
| Fiber diameter (Micrometer) | 10 | 7 | 7 | 7 | 7 | 4.5 | 2.7 | 2.0 |
| Fiber tenacity, gram per denier (gpd) | 2.5 | 3.5 | 4.5 | 6.0 | 2.5 | 6.0 | 6.0 | 5.4 |
| Fiber birefringence | .010 | .012 | .018 | .028 | .008 | .027 | .028 | .024 |

Table I shows that molecular orientation and fiber strength is at a maximum when the quench air velocity is at 105 meter/second. When the quench air velocity is too fast at 310 meter/second (Example 5), most of the orientation is lost. The fibers are blown into the draw jet and the draw jet does not exert any force upon the fibers. This condition resembles the melt-blowing process, which normally does not produce much molecular orientation. If no quench air is used (Example 1 and 2), Fibers were sticking together in the draw jet.

Table II shows the effect of quench air temperature on fiber orientation, as measured by tenacity and birefringence. If temperatures are too high above the melting point of the polymer, the fiber acceleration in the draw jet develops little orientation.

TABLE II

FIBER ORIENTATION AT VARIOUS TEMPERATURES

Polymer: polypropylene, MFR 400; Air pressure in cavity 5: 15 psi; polymer flow rate: 0.6 gram/nozzle/minute; Cold air vInelocity at draw jet: 310 m/sec.

| Example No: | 1 | 2 | 3 | 4 |
|---|---|---|---|---|
| Air temperature in cavity 5, ° C. | 180 | 190 | 210 | 230 |
| Fiber tenacity (gpd) | *** | 6.0 | 4.5 | 2.0 |
| Birefringence | *** | 0.028 | 0.015 | 0.008 |

***resin too viscous, no fibers formed

Table III, the effect of the quench air turned on and off is shown on various polymers. Here again, sticking of fibers in the draw jet was experienced when the quench air was turned off in examples 1,3,5 and 7, and fiber tenacities were lower.

TABLE III

NON-WOVEN FIBER ORIENTATION, VARIOUS POLYMERS

| Example: | 1 | 2 | 3 | 4 | 5 | 6 | 7 | 8 |
|---|---|---|---|---|---|---|---|---|
| Polymer | PP* | PP* | PET** | PET** | PE*** | PE*** | PS**** | PS**** |
| Melt temperature cavity 2, ° C. | 230 | 230 | 300 | 300 | 210 | 210 | 230 | 230 |
| Air temperature in cavity 5, ° C. | 230 | 230 | 310 | 310 | 220 | 220 | 230 | 230 |
| Air velocity below nozzle (m/sec) | 0 | 105 | 0 | 105 | 0 | 105 | 0 | 105 |
| Polymer flow rate per nozzle (g/min) | 0.5 | 0.5 | 0.3 | 0.3 | 0.3 | 0.3 | 0.4 | 0.4 |
| Cold air velocity at draw jet (m/sec) | 310 | 310 | 310 | 310 | 310 | 310 | 310 | 310 |

TABLE III-continued

NON-WOVEN FIBER ORIENTATION, VARIOUS POLYMERS

| Example: | 1 | 2 | 3 | 4 | 5 | 6 | 7 | 8 |
|---|---|---|---|---|---|---|---|---|
| Fiber diameter (micrometer) | 9 | 6 | 8 | 5 | 8 | 5 | 9 | 6 |
| Fiber tenacity (gpd) | 2.3 | 6.0 | 1.8 | 5.5 | 1.5 | 5.5 | 1.2 | 3.5 |

PP* = polypropylene, MFR 400; PET** = Polyethylene terephthalate, IV 0.55;
PE* = High Density Polyethylene, MI 35; PS** = General purpose polystyrene, MI 35.

In summarizing the invention, it is apparent from the examples that a number of features have to coincide in a multi-row spinnerette to affect the desired properties: In order to obtain acceptable spinning performance and fiber properties in a spinnerette providing high velocity air flow parallel to the fiber stream, the quench air has to be at an optimum temperature and pressure in relation to the polymer melt temperature, and the jet draw air has to be at a high velocity. There is nothing in the prior art to suggest that hot, expanding, high velocity air parallel to the fiber stream can be used as an effective quench medium.

While the invention has been described in connection with several exemplary embodiments thereof, it will be understood that many modifications will be apparent to those of ordinary skill in the art; and that this application is intended to cover any adaptations or variations thereof therefore, it is manifestly intended that this invention be only limited by the claim and the equivalents thereof.

What is claimed is:

1. An improved apparatus for producing fibers of a high degree of molecular orientation of the type wherein a fiberforming thermoplastic polymer is formed into a fiber stream and wherein said fibers are collected on a receiver surface in the path of said fiber stream to form a non-woven mat, the improvement of which comprises:

a polymer feed chamber for receiving said molten polymer, nozzle mounts having a plurality of nozzle means mounted in a spinnerette plate arranged in multiple rows for receiving said molten polymer from said polymer feed chamber for forming fine fiber, and having:

a) a multiplicity of nozzles arranged in at least two rows;

b) a gas cavity having a height of at least two times the outside diameter of said nozzles;

c) a gas plate to receive said nozzles, said gas plate having a hole pattern identical to said nozzle mounts and having holes which are larger than the outside diameter of said nozzles to pass gas from said gas cavity around said nozzles at high velocity to flow and expand parallel to said nozzles having ends protruding through said gas plate and the flow of said fibers exiting said nozzle ends, d) a jet drawing means, placed at a distance from said nozzles in the path of said fiber stream, receiving said fiber stream, and having air slots directing a flow of high velocity cold air away from said nozzles, said high velocity cold air accelerating said fiber stream away from said nozzles at a high velocity.

2. The apparatus of claim 1 wherein the holes in said gas plate are between 1.05 to 1.3 times the diameter of said nozzles.

3. The apparatus of claim 1 wherein the cross sectional opening for the hot gas to pass through said gas plate around each nozzle is at least 0.2 square millimeter.

4. The apparatus of claim 1 where said jet drawing means is mounted at least six centimeters away from said nozzle ends.

5. The apparatus of claim 4 where said jet drawing means has two air slots between which said fiber stream passes, said air slot having a width of between 0.1 and 3 millimeters.

6. The apparatus of claim 5 where said air slots are at least five millimeters apart.

7. A process for forming a non-woven mat of fibers having high molecular orientation and strength, comprising the steps of:

a) introducing a molten polymer into a feed chamber for receiving said polymer, said feed chamber communicating with a miltiplicity of extruding nozzles means mounted in a spinnerette plate and arranged in multiple rows, b) extruding the molten polymer through said nozzles to form fine fibers, c) simultaneously introducing a gas stream into a gas cavity said gas cavity being bounded on one side by said spinnerette plate and bounded on an opposite side by a gas plate and said nozzles pass through said gas chamber and said gas plate having holes in a pattern identical to the pattern of said spinnerette plate in which said nozzles are mounted, said holes having a diameter larger than said nozzles, said nozzles protruding through said holes in said gas plate, said gas is passed around said nozzles through said gas plate at a high velocity so as to flow and expand parallel to said fiber stream and attenuate and cool said molten fibers exiting said nozzles below their melt temperature, d) fiurther attenuating said fibers by a jet drawing means supplied by pressurized cold air, said jet drawing means being positioned in the path of said fiber stream, receiving said fiber stream and accelerating it to a velocity higher than the gas velocity exiting through the holes of said gas plate, e) collecting said fibers on a receiver in the path of said fibers to form a non-woven mat.

8. The process of claim 7 where the gas temperature in said gas chamber is between 10 to 60° C. higher than the melt temperature of said polymer.

9. The process of claim 7 where the gas velocity exiting said gas plate is between 10 and 250 meter per second.

10. The process of claim 7 where the gas exiting said jet drawing means has a velocity of between 50 and 330 meter per second.

11. The process of claim 7 where the gas exiting said jet drawing means has a velocity of at least 20 meter per second higher than the hot gas exiting through said gas plate holes around said nozzles.

* * * * *